US005314136A

United States Patent [19]

Vaida et al.

[11] Patent Number: 5,314,136

[45] Date of Patent: May 24, 1994

[54] STOP BRAKE FOR SUPPLY MANDREL

[76] Inventors: Robert M. Vaida, 132 Crystal Lake Rd., Ellington, Conn. 06029; Richard Kuchta, 67 Meadowwood Dr., Tolland, Conn. 06084; Philip W. Cenedella, 88 North St., East Douglas, Mass. 01516

[21] Appl. No.: 708,875

[22] Filed: May 31, 1991

[51] Int. Cl.[5] ..... B65H 23/08

[52] U.S. Cl. ..... 242/75.4; 242/75.43

[58] Field of Search ..... 242/75.4, 75.41, 75.42, 242/75.43

[56] References Cited

U.S. PATENT DOCUMENTS

| | | | |
|---|---|---|---|
| 2,336,751 | 12/1943 | Sandberg | 242/75.43 |
| 3,241,784 | 3/1966 | Bzdelik, Jr. et al. | 242/75.43 |
| 3,463,413 | 8/1969 | Smith | 242/75.43 |
| 3,520,485 | 7/1970 | Hank | 242/75.43 |
| 3,688,999 | 9/1972 | Plattner et al. | 242/75.43 |
| 3,885,747 | 5/1975 | Moss et al. | 242/75.43 |
| 3,899,143 | 8/1975 | Slezak | 242/75.43 |
| 3,937,422 | 2/1976 | Kato | 242/75.4 |
| 4,074,873 | 2/1978 | Hayashi et al. | 242/75.43 |
| 4,350,454 | 9/1982 | Schoenlein | 242/75.43 |
| 4,646,911 | 3/1987 | Pearl et al. | 198/689.1 |
| 5,011,561 | 4/1991 | Carolus et al. | 242/75.43 |

FOREIGN PATENT DOCUMENTS

| | | | |
|---|---|---|---|
| 3-98944 | 4/1991 | Japan | 242/75.42 |

*Primary Examiner*—Daniel P. Stodola
*Assistant Examiner*—John Q. Nguyen
*Attorney, Agent, or Firm*—McCormick, Paulding & Huber

[57] ABSTRACT

A stop brake for a supply roll mandrel includes at least one brake arm pivotally connected to a support and capable of being pivoted out of braking engagement with the mandrel in response to advancement of sheet material from a supply roll against the return bias of a spring element. The brake arm cooperates with sheet material which is caused to follow a path around a dancer bar secured to the lower end of the brake arm causing the disengagement of the brake. The brake is caused to cooperate with the outer surface of a mandrel upon which a supply roll is mounted through a intermediary of a strap which holds the mandrel surface against rotation when advancement of sheet material is stopped.

16 Claims, 4 Drawing Sheets

STOP BRAKE FOR SUPPLY MANDREL

BACKGROUND OF THE INVENTION

The present invention resides in a roll dispenser capable of feeding sheet material out over a work surface, and deals more particularly with a brake for such a dispenser in which a means is provided for feeding out a discreet section of sheet material from a supply roll and stopping the supply roll with the advancement of the sheet material from the roll.

Conveyorized vacuum tables used for supporting a layup of the sheet material and advancing it to a work station where a work operation is performed on it, such as cutting, are well known. One such type of vacuum table is disclosed in U.S. Pat. No. 4,646,911, issued to David Pearl on Mar. 3, 1987. In this patent, it is disclosed that a conveyorized belt comprised of sections or slats of penetrable bristle surfaces which form a bed for supporting the sheet material and advancing the sheet material towards a final station may be employed for this purpose. A vacuum is provided which migrates longitudinally and laterally through the bristles thereby compressing and holding the sheet material in place on top of the conveyor for cutting by an automatically controlled cutting blade. To assist in the compaction of the sheet material which usually is several plies thick onto the work surface by the vacuum, it is often desirable to use a thin film of plastic which is drawn over the topmost ply of the layup. Often, the supply of sheet material and the associated section of film are drawn together across the work surface with the advancement of the conveyor belt. Alternatively, the roll of sheet material may itself be advanced across the work surface to effect covering of the underlying layup. Regardless of how the supply of sheet material is advanced, it has been found that the film of plastic or any other nonpermeable sheet material which may be chosen for this purpose often does not unwind from the supply roll in increments corresponding to the amount advanced. That is, the inertia generated by the roll as the film is being pulled off continues the rotation of the supply roll even after the advancement of the film. Additionally, it has been found that in unwinding from the supply roll, the film generates a static electric charge which, if not grounded, can adversely affect the functioning of sensors and other electrical components in the machine.

Accordingly, it is an object of the present invention to include as part of the supply roll support a means which allow the supply roll to rotate freely with the advancement of the sheet material from the supply roll but which stops the rotation of the supply roll when advancement of sheet material is complete such that the sheet material unwinds evenly in conjunction with its advancement.

Still a further object of the present invention is to provide a supply roll brake which is low cost and of highly durable construction so as to be capable of repeatedly being used without need of replacement or substantial adjustment.

Yet a further object of the present invention is to provide a feeding mechanism for a supply roll of the aforementioned type wherein the mechanism allows a supply roll to be readily replaced with a new roll of sheet material without significantly altering the machine itself.

Still a further object of the present invention is to provide a material handling system in which the sheet material which unwinds from the supply roll is of the type of in which a static charge generated as a result of unwinding is readily dissipated.

Further objects and advantages of the present invention will become apparent by the following disclosure and the appended claims.

SUMMARY OF THE INVENTION

A supply roll brake comprises a support and at least one brake arm pivotally connected to the support for rotation about a pivotal axis. The brake arm has a first end portion and an opposite second end portion and includes holding means associated with the brake arm first end portion for gripping and holding a surface, such as on a mandrel, against rotation when the brake arm is in a first given orientation relative the support. The brake arm further includes biasing means associated with the brake arm second end portion for urging the brake arm towards the first given orientation. The brake also includes a means secured to the brake arm adjacent its second end for engaging with and directing sheet material away from a supply roll and for causing the brake arm to be rotated away from the first given orientation.

BRIEF DESCRIPTION OF THE PREFERRED EMBODIMENT

Figure 1:
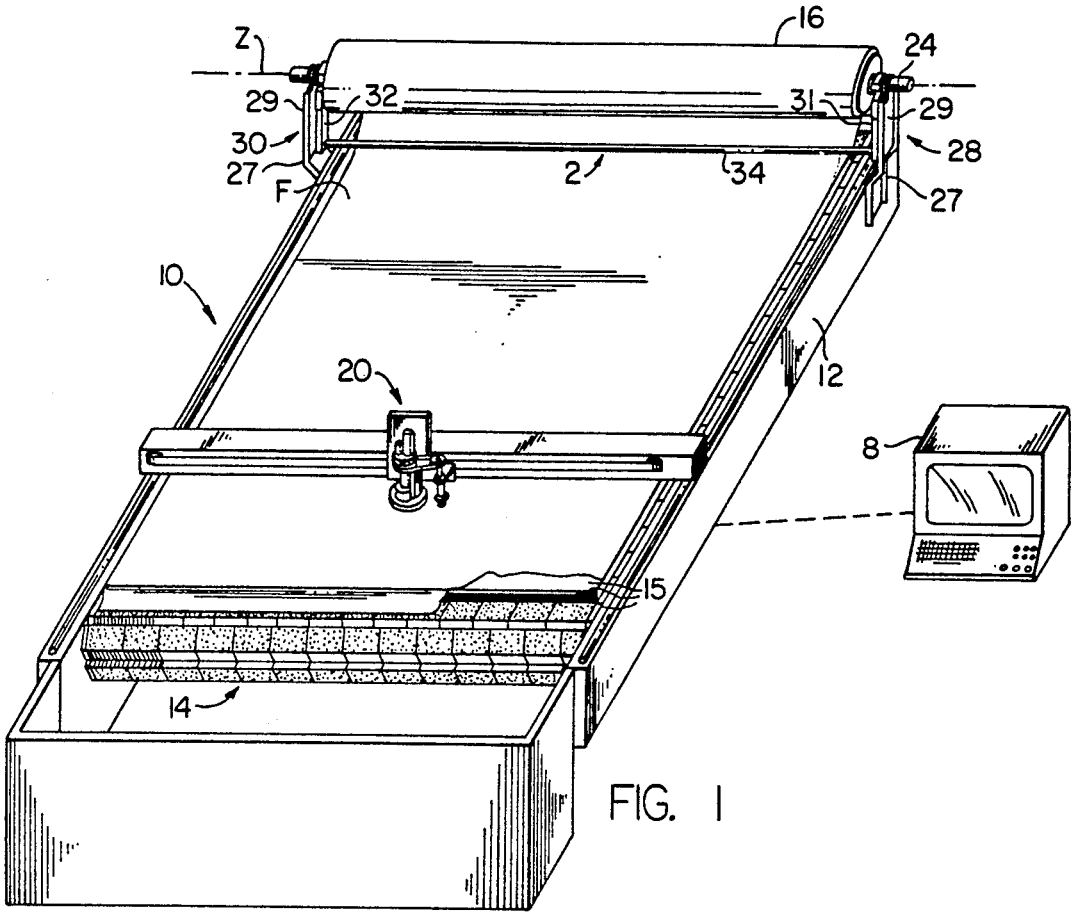
FIG. 1 is a perspective view showing the present invention as it is embodied in a cutting machine.

FIG. 1 illustrates a conveyorized vacuum table generally designated 10 in which the invention is embodied. The table 10 includes a frame 12, a conveyor 14 for supporting and transporting sheet material 15 in a layup form, a vacuum hold down system for holding the sheet material 15 unto the conveyor 14, a cutter assembly 20 for cutting the sheet material 15 and a controller 8, including a computer, for numerically controlling the cutter assembly in coordinated movement with the conveyor 14 for cutting a desired closed shape into the layup of sheet material 15. The conveyorized transport table 10 further includes a roll of air impermeable film or sheet material F, preferably plastic, which is drawn over with the advancing layup 15 to cover the exposed upper ply of sheet material comprising the layup thereby allowing the vacuum to draw and compact the sheet material layup down onto the cutting bed and compressing it into a rigid mass. The sheet material F may be advanced off the roll 16 with the movement of the layup by the conveyorized support 14, or the roll 16 may alternatively itself be advanced over the sheet material through the intermediary of a carriage which moves the roll 16 along the longitudinal extent of the vacuum table 10, or in certain circumstances the sheet material may be manually advanced off the supply roll.

The supply roll 16 is nonrotatably mounted on a mandrel 24 supported for rotation at each end on upstanding members 28 and 30 which support it generally horizontally for rotation about a central axis Z adjacent the feeding end of the vacuum table 10. To this end, each of the upstanding members 28 and 30 includes a pair of support rollers 26,26 which are received within at least one channel formed on the mandrel 24 to hold the mandrel against axial displacement while it rotates. The upstanding members 28 and 30 are generally vertically extending members that have a base portion 27 and an offset upper portion 29 each integrally connected to the other through the intermediary of a lateral offset connection. The lateral offset orients the upper portions 29,29 away from the table 10 so as to allow a generally U-shaped member 2 to be received between each of the upstanding supports 28 and 30.

Figure 2:
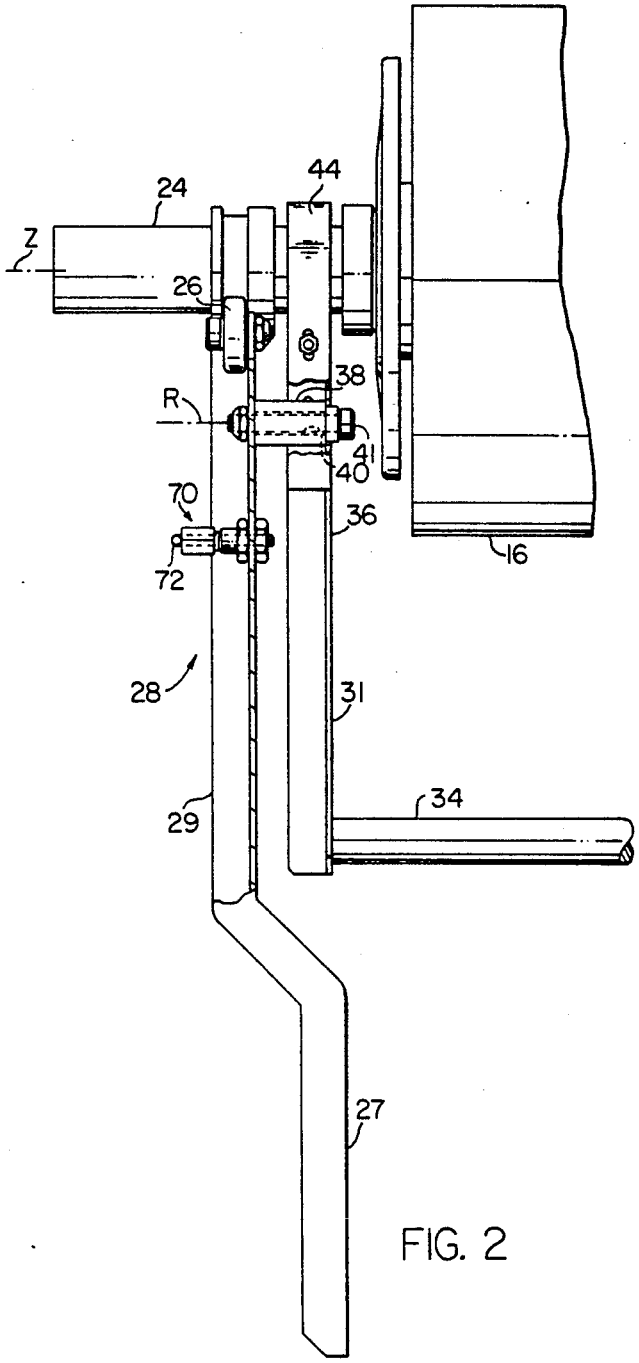
FIG. 2 is a partially fragmentary rear elevation view of one side of the supply roll support and its associated braking mechanism.
Figure 3:
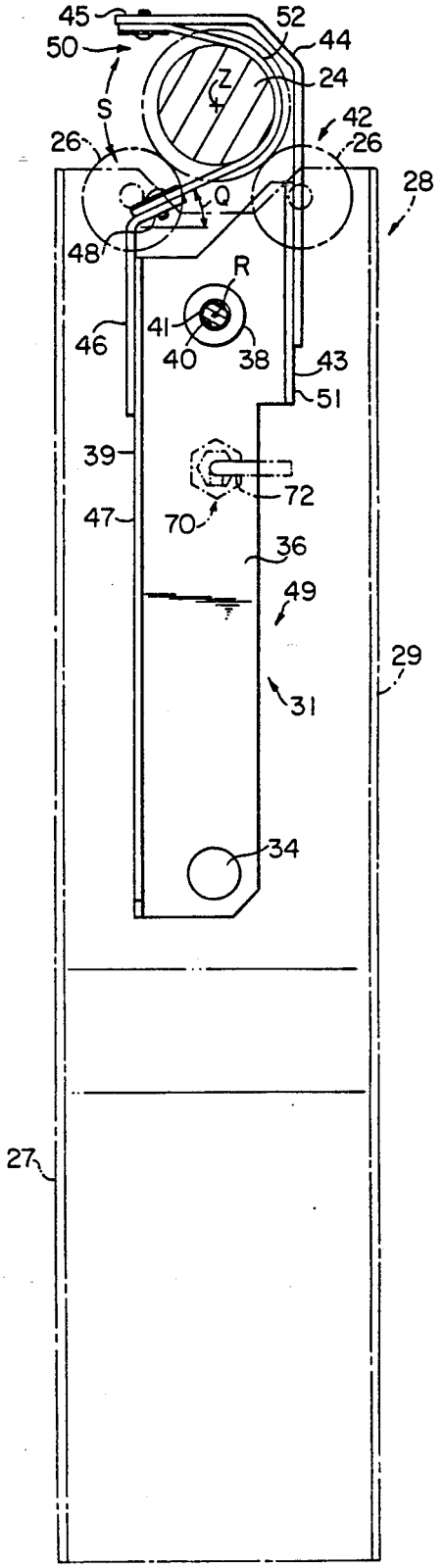
FIG. 3 is a partially fragmentary side elevation view showing the right side braking mechanism.

The generally U-shaped member 2 is provided in accordance with the invention for controlling the rotation of the mandrel 24 and includes for this purpose a first and a second brake arm 31 and 32 each pivotally supported on the upper portions of the respective upstanding members 28 and 30 and are each interconnected to one another by a dancer bar 34 extending transversely to the path followed by the sheet material F as it is advanced off the roll 16. As seen in FIGS. 2 and 3, each of the brake arms 31 and 32 is comprised of a generally elongate bracket 36, having an upper bracket portion 42 and a lower bracket portion 49 separated from one another by a journalling part 38 fixed to the bracket. The journalling part 38 pivotally connects each brake arm to one of the upstanding support members 28 and 30 through the intermediary of an opening 40 through which is received a pin or bolt 41. In this way, the generally U-shaped member 2, through the component brake arms 31 and 32, is caused to rotate about a second axis R disposed parallel to the central axis Z.

Each upper bracket portion 42 of the brake arms includes a means 50 for engaging with and holding the outer surface with the mandrel 24 against rotation. For this purpose, each upper bracket portion 42 is comprised of a generally L-shaped first part 44 extending initially parallel to the rear face 43 of the brake arm and is directed inwardly therefrom to create a generally pocket-like confine therein. The upper bracket portion 42 further includes a second part 46 which extends generally parallel with the front face 39 of each brake arm and is inturned at angle O toward the pocket-like confine at an angle of approximately 25 degrees and terminating a distance from the free end of the L-shape first part 44 so as to define a space S extending generally between each of the first and second parts 44 and 46. The brackets 36,36 which define each of the brake arms each has an inturned flange 51 defining its rear face 43 and a continuous inturned flange 47 extending along the front face 39 thereof. Each of these flanges has a width substantially equaly that of the first L-shaped part 44 and of the second part 46 such that they provide a base onto which each of these parts can be secured by such conventional means as bolting. These flanges further enhance the overall strength and resistance against bending by the brake arms 31 and 32 during the material advancement process. While the brake arms are disclosed in the preferred embodiment as being of multipiece construction, it is possible for the brake arms to alternatively be cast or molded as an unitary piece.

Secured within the pocket-like confine of the upper bracket portions 42,42 of each of the brake arms is the means 50 which engages and grips the outer surface mandrel 24 to stop it from rotating. This means includes a conformable strap of resilient material having a multisurface configuration facing the mandrel 24 engaged by it. It is noted that the strap 52 is secured to each upper bracket portion 42,42 respectively at the free ends 45 and 48 of the first and second parts 44 and 46 such that the strap 52 generally defines a concave surface into which the correspondingly shaped outer surface of the mandrel 24 is received. The strap 52 being conformable to the outer surface of the mandrel thereby maximizes the contact surface between the two members thus effecting enhanced gripping.

Figure 4A:
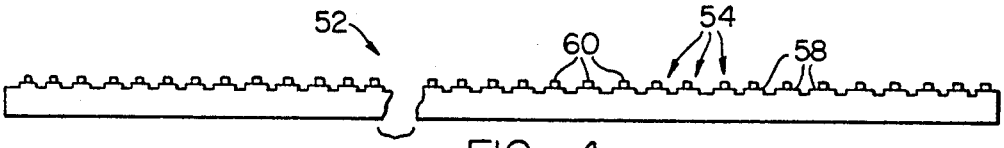
FIG. 4*a* is a side elevation of the holding strap shown separately from the braking mechanism.
Figure 4B:
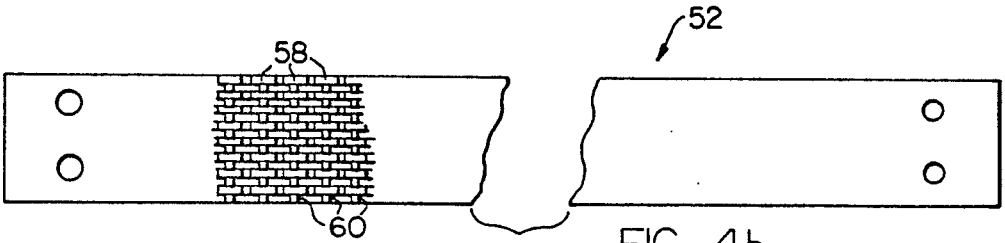
FIG. 4*b* is a top plan view of the holding strap shown in FIG. 4*a*.

As is shown in FIGS. 4*a* and 4*b*, the strap 52 includes a generally elongate strip-like member 52 having a series of transversely extending rows of projections 54,54 formed thereon. The generally transverse orientation of these rows serves to provide effective and enhanced gripping of the outer mandrel surface since the longitudinal extent of the more elongate of these projections when so oriented in this manner is coincident with the rotational direction of the mandrel. The projections 54,54 together present a multisurface configuration when seen in side view, as defined by a plurality a base projections 58,58 having a first given height defining a first engagement surface and a plurality of a taller projections 60,60 having a second given height each defining a second engagement surface which extends outwardly beyond the first surface and towards the mandrel 24 so as to provide an initial gripping surface yielding to subsequent engagement by the lower first surface defined by the base projections 58,58 upon continued urging of the strap 52 towards the mandrel 24. While the strap 52 may be made from different materials which accomplish the desired function at hand, including taking the form of a plurality of pads of material disposed in a circular arrangement, one example of material suitable for these ends is commercially available by Belt Serve Corp., under the name Gum Rough Top x Friction Surface, 3 Ply CN40, #59.

Figure 5A:
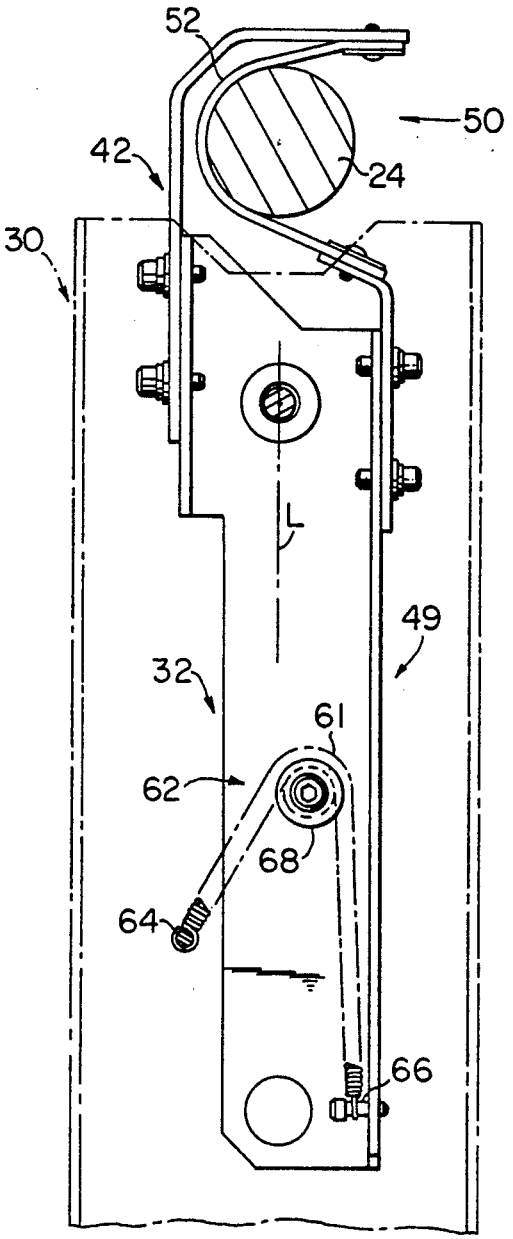
FIG. 5*a* is a side elevation view showing schematical the arm return biasing means.
Figure 5B:
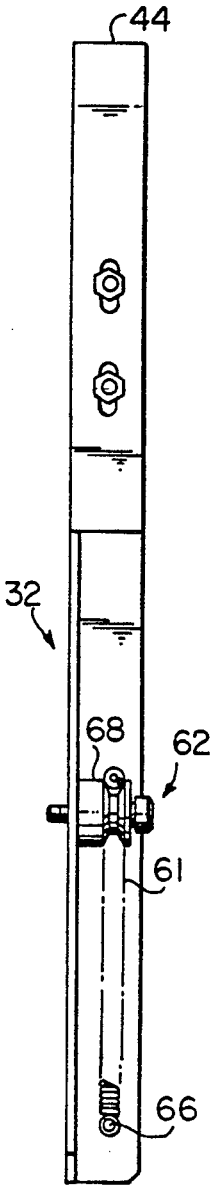
FIG. 5*b* is a view of the arm return biassing means as seen from the rear in FIG. 5*a*.

FIGS. 5*a* and 5*b* show the gripping means 50 normally biased into engagement with the mandrel outer surface by spring means 62. The spring means 62 is comprised of an elongate coil spring 61 having a first end secured against movement to the associated one of the upstanding support members 28,30 at the illustrated point 64,64 and having its second opposite end secured to the end of the lower portion 49 of the involved brake arm at point 66. Since the lower portion 49 of each brake arm is generally longer than its corresponding upper portion 42, the attachment point 66 creates a relatively strong moment arm serving to more strongly urge the holding means 50 into engagement with the mandrel. The spring 61 is made to react between points 64 and 66 about a pulley 68 mounted on each brake arm slightly offset from the bracket longitudinal axis L. The spring means 62 is of such a length and has characteristics that provides a biasing force maintaining coengagement between the holding means 50 and the outer surface of the mandrel 24 even when sheet material is not being advanced. This arrangement of the spring means 62 is further advantageous in that it generates a substantially uniform biassing force on the brake arms as they are caused to rotate away from the spindle 24.

Figure 6:
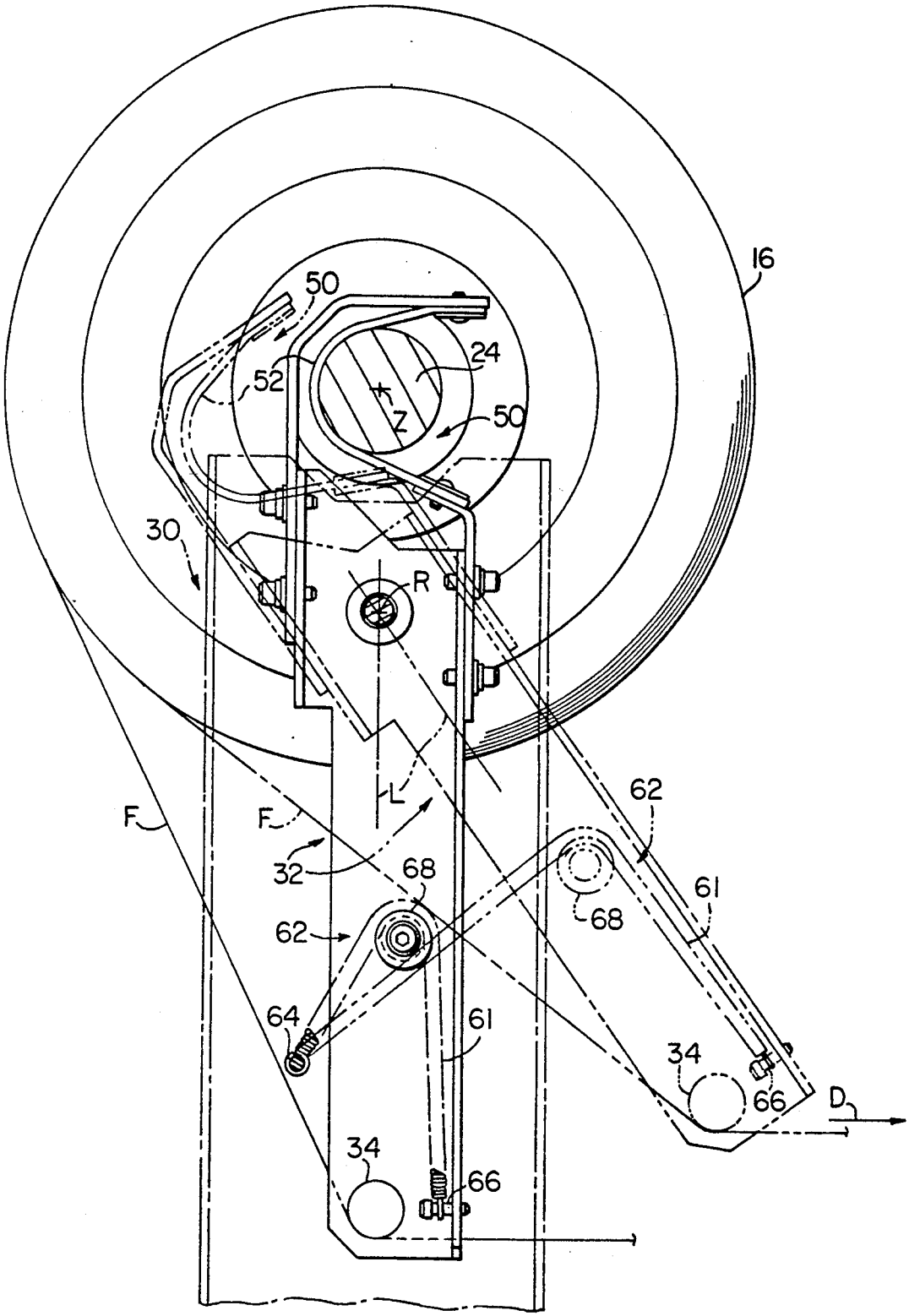
FIG. 6 is a schematic view of the operation of the brake mechanism.

In use, the generally U-shaped member 2 constituted by the two brake arms 31 and 32 rigidly interconnected with one another by the dancer bar 34, is caused to pivot around the axis R by the advancement of the sheet material F from the supply roll 16 and over the work surface. As seen in FIG. 6, this is accomplished by the sheet material being drawn off the supply roll 16 and caused to follow a path around the dancer bar 34 whereupon it is then directed towards the table 10. In this manner, the holding means 50,50 associated with each brake arm is thus moved out of contact with the mandrel 24 by the advancement of the sheet material F by its pulling action, thus causing the dancer bar to be moved in the advancement direction D and against the biasing force of the spring means 62 as shown in phamtom line. The spring tension is selected such that the force is sufficiently strong to return the brake arms 31,32 back into gripping relationship with the outer mandrel surface 24, yet is sufficiently yieldable to allow the sheet material F in its advancement to rotate the brake arms so as to move the gripping means 50,50 out of engagement with the outer surface of the mandrel. Once advancement of a given section of the sheet material F is stopped, the dancer bar then returns to its normal condition wherein the engaging surfaces of the holding means 50,50 are caused to again grip the outer surface of the mandrel 24 and prevent it from rotating. To allow the supply roll 16 to be readily replaced without hinderance by the brake mechanism, a blocking pin assembly 70 is provided and is mounted on at least one of the support members 28 and 30. The blocking assembly 70 includes a sliding pin 72 selectively actuated to an extended blocking condition and located on its upstanding support such that the associated brake arm is held at an angular disposition where the holding means 50,50 is rotated clear of the mandrel 24.

From the foregoing, a supply roll brake has been disclosed in the preferred embodiment of the invention. However, numerous modifications and substitutions may be had without departing from the spirit of the invention. For example, while the spring means 62 has been described as including an elongated coil spring, it is contemplating within the scope of the invention to provide a torsion spring placed about the pivot bolt or pin 41 between the upstanding support and the brake arm and about the pivot axis R.

Accordingly, the present invention has been described by way of illustration rather than limitation.

We claim:

1. A supply roll brake comprising:

a support;

at least one brake arm pivotally connected to said support for rotation about a pivot axis;

said at least one brake arm having a first end portion and an opposite second end portion with said pivot axis being interposed therebetween, said at least one brake arm being pivotal about said pivot axis between a first given orientation and a second different orientation;

holding means associated with said brake arm first end portion for gripping and holding a portion of a cylindrical surface against rotation when said brake arm is in said first given orientation relative to said support;

biasing means associated with said brake arm second end portion for urging said brake arm toward said first given orientation;

said holding means including a flexible strap;

said at least one brake arm at the first end portion thereof having means for attached said flexible strap to said at least one brake arm such that said flexible strap is connected to the first end portion of said brake arm so as to create a conformable pocket thereon opening toward said cylindrical surface and allowing the first end portion of said at least one brake arm to be moved away from said cylindrical surface as the at least one brake arm moves from said first given orientation to said second different orientation; and means secured to said brake arm along said second end portion thereof for engaging with and directing sheet material away from a supply roll carried on said cylindrical surface and for causing said brake arm to be pivoted about said pivot axis away from said first given orientation and to said second different orientation in response to advancement of sheet material from the supply roll.

2. A supply roll brake as defined in claim 1 further characterized in that said at least one brake arm includes a journalling part having means for pivotally connecting it to said support for rotation about said pivot axis; and said journalling part dividing said at least one brake arm between said first end portion associated with said holding means and said second end portion associated with said biasing means such that the second end portion of said at least one brake arm creates an effective moment arm for biassing the holding means into engagement with said cylindrical surface.

3. A supply roll brake as defining claim 2 further characterized by said means for engaging and directing sheet material including a bar extending outwardly from the second end portion of said at least one brake arm so as to extend generally transversely to the path of said travel of sheet material.

4. A supply roll brake as defining claim 3 further characterized in that said at least one brake arm includes a front face and a rear face extending generally parallel to the longitudinal extent of the brake arm;

said holding means being secured to said at least one brake arm by a first L-shaped part fixed to said rear face of said at least one brake arm and to a second part secured to said front face of said at least one brake arm.

5. A supply roll brake as defined in claim 4 further characterized in that said second part has a free end and is directed that toward said generally L-shaped first part at an angle of approximately 25 degrees.

6. A supply roll brake as defined in claim 3 further characterized in that said strap comprising said holding means includes a means presenting a multisurface configuration defined by a plurality of rows of projections extending transversely of the longitudinal extent of the strap; and wherein each row of projections includes a alternating series of base and taller projections, said taller projections presenting a first surface and said base projections presenting a second surface with the first surface being disposed higher than said second surface taken relative to a backing to which said projections are secured.

7. A supply roll brake as defined in claim 3 further characterized in that said biasing means includes an elongate spring and a pulley located intermediately along the second end portion of said at least one brake arm and said journalling part;

one end of said spring being secured to the second end portion said brake arm laterally offset from the location of said pulley on said brake arm and the other end of said spring being attached to said support such that said spring extends therebetween and engages said pulley.

8. A supply roll brake as defined in claim 7 further characterized in that said support includes a retractable pin member capable of extending outwardly into blocking engagement with the path of travel of the brake arm so as to hold the brake arm at a predetermined angular orientation other than at said first given orientation and against the urging of said biasing means.

9. In combination with a supply roll mandrel supported for rotation about its central axle on a conveyorized transport table of the type having a means for drawing a length of sheet material from the supply roll to cover material laid onto the table to be worked on, a brake cooperating with the mandrel having an outer surface for stopping rotation thereof, said brake comprising:

a means for supporting the mandrel for rotation about said central axis of rotation;

said support means including first and second generally upstanding members spaced from one another a distance less than the length of said mandrel;

a generally U-shaped member having a transversely extending bar extending generally substantially across the spacing between said first and second generally upstanding members for the purpose of engaging said sheet material as it feeds from the supply roll, said generally U-shaped member further being defined by two brake arms each connected to said transversely extending bar at opposite ends thereof;

each of said brake arms including a means for pivoting the brake arm about a common pivot axis oriented parallel to said central axis of rotation of said mandrel between a first given orientation and a second orientation;

each of said brake arms further including an upper end portion and a lower end portion, the lower end portions each being associated with said transversely extending bar and the upper end portions thereof each including a holding means for engaging with and holding said mandrel outer surface to prevent it from rotating;

said holding means being engaged with the outer surface of the mandrel when each of said brake arms is in said first given orientation and being maintained out of engagement with the outer surface of the mandrel when in said second given orientation corresponding respectively to when said means for drawing sheet material off said supply roll is not activated and when it is activated;

biasing means interposed between each of said first and second generally upstanding support members and each brake arm of said generally U-shaped member to normally urge said generally U-shaped member toward said mandrel and maintain it in said given first orientation when said means for drawing sheet material off said supply roll is not activated, each of said brake arms includes a journalling part which receives a pivot pin therein, said pivot pin pivotally connecting each of the first and second upstanding members to its associated brake arm;

said journalling part associated with each brake arm being located between the upper end portion and the lower end portion of each brake arm;

disposed at the upper end portion of each of said two brake arms is a generally L-shaped part defining a pocket therein; and wherein said holding means further includes a strap formed from flexible material capable of conforming about a portion of the outer surface of said mandrel when each of said brake arms are in said first given orientation.

10. The combination as set forth in claim 9 further characterized in that each of said brake arms includes a pulley disposed thereon offset from a longitudinal axis on which the journalling axis is located;

each of said brake arms being pivotally connected to the one of the first and second generally upstanding support members associated with it along the brake arm longitudinal axis;

said biassing means including an elongate spring connected between a first point at the lower end portion of each brake arm and a second point at the upstanding member associated with it; and said elongate spring being directed around the pulley associated with it between said first and second points to cause each of said brake arms to be drawn uniformly toward said first given orientation.

11. The combination as set forth in claim 10 further characterized in that said strap includes a multisurface configuration facing said mandrel, said configuration including a plurality of projections disposed in rows extending transversely to the longitudinal extent of said strap;

said projections in each row alternating in height between a base projection and a taller projection, the base projections defining a first engagement surface and the taller projections defining a second engagement surface of a height which is greater than that of the first surface.

12. The combination as set forth in claim 9 further characterized in that the pivotal connection between each of said support means and said generally U-shaped member is capable of conducting an electric current therethrough; and wherein each of said two upstanding support members is laterally offset at its top portion relative to its lower portion such that said offset increases the spacing between each of said support members at the top portions thereof to allow for the generally U-shaped member to be received in pivotal relationship therewith.

13. The combination as set forth in claim 12 further characterized in that said mandrel nonrotatably supports a roll of air impermeable sheet material and said sheet material is advanced from its roll and around the transversely extending bar for being directed away therefrom.

14. The combination as set forth in claim 13 wherein the sheet material is a plastic film.

15. In combination with a supply roll mandrel supported for rotation about its central axis on a conveyorized transport table of the type having a means for drawing a length of sheet material from the supply roll to cover material laid onto the table to be worked on, a brake cooperating with the mandrel having an outer surface for stopping rotation thereof, said brake comprising:

a means for supporting the mandrel for rotation about said central axis of rotation;

said support means including first and second generally upstanding members spaced from one another a distance less than the length of said mandrel;

a generally U-shaped member having a transversely extending bar extending generally substantially across the spacing between said first and second generally upstanding members for the purpose of engaging said sheet material as it feeds from the supply roll; and generally U-shaped member further being defined by two brake arms each connected to said transversely extending bar at opposite ends thereof;

each of said brake arms including a means for pivoting the brake arm about a common pivot axis oriented parallel to said central axis of rotation of said mandrel between a first given orientation and a second orientation;

each of said brake arms further including an upper end portion and a lower end portion, the lower end portions each being associated with said transversely extending bar and the upper end portions thereof each including a holding means for engaging with and holding said mandrel outer surface to prevent it from rotating;

said holding means being engaged with the outer surface of the mandrel when each of said brake arms is in said first given orientation and being maintained out of engagement with the outer surface of the mandrel when in said second given orientation corresponding respectively to when said means for drawing sheet material off said supply roll is not activated and when it is activated; and biasing means interposed between each of said first and second generally upstanding support members and each brake arm of said generally U-shaped member to normally urge said generally U-shaped member toward said mandrel and maintain it in said given first orientation when said means for drawing sheet material off said supply roll is not activated;

said holding means associated with each of said brake arms is configured such that it cooperates with said means supporting said mandrel for rotation about said central axis such that said mandrel is restrained against moving away from said means supporting said mandrel when each of said brake arms is in said first given orientation;

said holding means is configured as a pocket conformable to the surface of said mandrel when engaged with the mandrel to hold the mandrel in braking engagement with the brake arms against rotation.

16. The combination as set forth in claim 15 further characterized in that means are provided on each of said upstanding support members for holding said generally U-shaped member in an angular orientation other than at said first orientation to allow a replacement of said mandrel with a new roll of sheet material.

* * * * *